US011892209B2

(12) United States Patent
Jung et al.

(10) Patent No.: US 11,892,209 B2
(45) Date of Patent: Feb. 6, 2024

(54) MULTI-AIR CONDITIONER FOR HEATING AND COOLING INCLUDING A SHUT-OFF VALVE BETWEEN INDOOR AND OUTDOOR UNITS AND CONTROL METHOD THEREOF

(71) Applicant: LG ELECTRONICS INC., Seoul (KR)

(72) Inventors: Jaehwa Jung, Seoul (KR); Yongcheol Sa, Seoul (KR); Chiwoo Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 72 days.

(21) Appl. No.: 17/409,929

(22) Filed: Aug. 24, 2021

(65) Prior Publication Data

US 2022/0065505 A1 Mar. 3, 2022

(30) Foreign Application Priority Data

Aug. 28, 2020 (KR) ..... 10-2020-0109353

(51) Int. Cl.
*F24F 11/36* (2018.01)
*F25B 41/24* (2021.01)
(Continued)

(52) U.S. Cl.
CPC ..... *F25B 41/24* (2021.01); *F24F 11/36* (2018.01); *F25B 40/02* (2013.01); *F25B 41/31* (2021.01);
(Continued)

(58) Field of Classification Search
CPC ..... F25B 40/02; F25B 41/24; F25B 49/022; F25B 2500/222; F25B 2500/27;
(Continued)

(56) References Cited

U.S. PATENT DOCUMENTS 6,701,722 B1 3/2004 Seo et al.
2014/0041401 A1 2/2014 Douglas
(Continued)

FOREIGN PATENT DOCUMENTS

CN 1566826 1/2005
CN 109661547 4/2019
(Continued)

OTHER PUBLICATIONS

European Search Report issued in Application No. 21192584.7 dated Jan. 20, 2022.
Chinese Office Action dated Dec. 2, 2022 issued in Application No. 202110863708.X.
Chinese Office Action dated Jun. 30, 2023 issued in Application No. 202110863708.X.

*Primary Examiner* — Jonathan Bradford
(74) *Attorney, Agent, or Firm* — KED & ASSOCIATES, LLP

(57) ABSTRACT

A multi-air conditioner for heating and cooling may include at least one indoor unit, an outdoor unit, and at least one leak shut-off valve. The at least one indoor unit is installed in an indoor space and includes an indoor heat exchanger and an indoor expansion valve. The outdoor unit is connected to the at least one indoor unit via a refrigerant pipeline and includes an outdoor heat exchanger, a compressor, an outdoor expansion valve, and a four-way valve. The outdoor unit may decrease a pressure of the refrigerant pipeline when a refrigerant leak occurs from the refrigerant pipeline. The at least one leak shut-off valve is provided on the refrigerant pipeline and blocks a flow of refrigerant in the refrigerant pipeline when a refrigerant leak from the refrigerant pipeline occurs in the indoor space.

3 Claims, 8 Drawing Sheets

(51) Int. Cl.

| | |
|---|---|
| ***F25B 41/31*** | (2021.01) |
| ***F25B 40/02*** | (2006.01) |
| ***F25B 49/02*** | (2006.01) |
| *F25B 41/20* | (2021.01) |

(52) U.S. Cl.
CPC ..... *F25B 49/022* (2013.01); *F25B 41/20* (2021.01); *F25B 2500/22* (2013.01); *F25B 2500/222* (2013.01); *F25B 2500/27* (2013.01); *F25B 2600/0251* (2013.01); *F25B 2600/2501* (2013.01); *F25B 2600/2513* (2013.01); *F25B 2600/2515* (2013.01); *F25B 2600/2519* (2013.01)

(58) Field of Classification Search
CPC ..... F25B 2600/0251; F25B 2600/2501; F25B 2600/2513; F25B 2600/2515
See application file for complete search history.

(56) References Cited

U.S. PATENT DOCUMENTS

| | | | | |
|---|---|---|---|---|
| 2014/0053587 | A1* | 2/2014 | Arii ..... | F25B 49/022 62/196.1 |
| 2021/0010704 | A1 | 1/2021 | Kawashima et al. | |
| 2021/0131706 | A1* | 5/2021 | Yamada ..... | F25B 49/02 |

FOREIGN PATENT DOCUMENTS

| | | |
|---|---|---|
| CN | 110168288 | 8/2019 |
| EP | 3 315 880 | 5/2018 |
| EP | 3 569 944 | 11/2019 |
| WO | WO 2017/010007 | 1/2017 |
| WO | WO 2019/198134 | 10/2019 |

* cited by examiner

MULTI-AIR CONDITIONER FOR HEATING AND COOLING INCLUDING A SHUT-OFF VALVE BETWEEN INDOOR AND OUTDOOR UNITS AND CONTROL METHOD THEREOF

CROSS-REFERENCE TO RELATED APPLICATION(S)

This application claims priority under 35 U.S.C. § 119 to Korean Application No. 10-2020-0109353, filed in Korea on Aug. 28, 2020, whose entire disclosure(s) is/are hereby incorporated by reference.

BACKGROUND

1. Field

A multi-air conditioner for heating and cooling and a method for controlling a multi-air conditioner for heating and cooling are disclosed herein.

2. Background

Generally, a multi-air conditioner is an air conditioner in which a plurality of indoor units is connected to a single outdoor unit, and which uses the common outdoor unit and the plurality of indoor units each as a cooler or a heater. A recent trend is that a plurality of outdoor units is connected in parallel to each other so as to effectively cope with a cooling or heating load, corresponding to the number of indoor units in operation.

A multi-air conditioner according to the conventional art includes a plurality of outdoor units, a plurality of indoor units, and refrigerant piping that connects the plurality of outdoor units and indoor units. The plurality of outdoor units is comprised of a main outdoor unit and a plurality of sub outdoor units.

Each of the plurality of outdoor units is provided with a compressor that compresses a low-temperature, low-pressure gas refrigerant into a high temperature and high pressure, an outdoor heat exchanger that exchanges circulating refrigerant with outdoor air, and a four-way valve that switches a flow of refrigerant depending on a cooling or heating operation. An expansion mechanism and an indoor heat exchanger that exchanges heat between circulating refrigerant and indoor air are installed on each of the plurality of indoor units.

With this configuration, when the multi-air air conditioner according to the conventional art is in a cooling operation, refrigerant compressed in the compressors of the main outdoor unit and sub outdoor units is sent to the outdoor heat exchanger by the four-way valve, and refrigerant passing through the outdoor heat exchanger is condensed through heat exchange with ambient air and then sent to the expansion mechanism. Refrigerant expanded in the expansion mechanism is introduced into the indoor heat exchanger and evaporates as it absorbs heat from indoor air, thereby cooling the indoor space. On the other hand, in a heating operation, a direction of flow is switched by the four-way valve, and refrigerant discharged from the compressor passes successively through the four-way valve, the indoor heat exchanger, an outdoor electronic expansion valve (or linear expansion valve (LEV)), and the outdoor heat exchanger, thereby heating the indoor space.

Changes are being made to regulations on fluorinated gas (F-gas) emissions and regulations on refrigerants for mandatory greenhouse gas reductions, which create a need for strategic development of products to respond to these changes. More specifically, the International Electrotechnical Commission (IEC) has made regulation changes on its standards by introducing limits on refrigerant leak amounts in the revised seventh edition, whereas the sixth edition had limits on refrigerant charge sizes. Therefore, more emphasis is being placed on the need for refrigerant leak control.

U.S. Patent Application No. 2014/0041401A1, which is hereby incorporated by reference, discloses a technique in which a leak detection sensor for detecting refrigerant leaks is mounted in each room, and in the event of a refrigerant leak, a refrigerant leak mode is enabled to close a solenoid valve and operate a compressor, allowing refrigerant to collect as the compressor draws in it and reducing a low pressure as low as atmospheric pressure. If the valve is shut off as described in U.S. Patent Application No. 2014/0041401A1, an amount of refrigerant leaking may be relatively small, but the amount of refrigerant leakage will not be negligible if indoor piping is lengthened and a refrigerant leak occurs in a liquid pipe.

Moreover, in the case of a refrigerant leak shown in FIG. 1A and FIG. 1B of the present application, it is hard to determine a position of the leak. Thus, in a case in which a shut-off valve is disposed in an indoor space, if refrigerant leaks between an indoor unit and the shut-off valve as in FIG. 1A or between the shut-off valve and the indoor space as in FIG. 1B, leaked refrigerant remains in the indoor space.

Such a refrigerant leak indoors could have a deadly effect on the user. Accordingly, if refrigerant leakage is unavoidable, the system needs to be configured in such a way as to have as little refrigerant leakage as possible and minimize damage to the user.

BRIEF DESCRIPTION OF THE DRAWINGS

Embodiments will be described in detail with reference to the following drawings in which like reference numerals refer to like elements, and wherein.

DETAILED DESCRIPTION

Figure 1A:
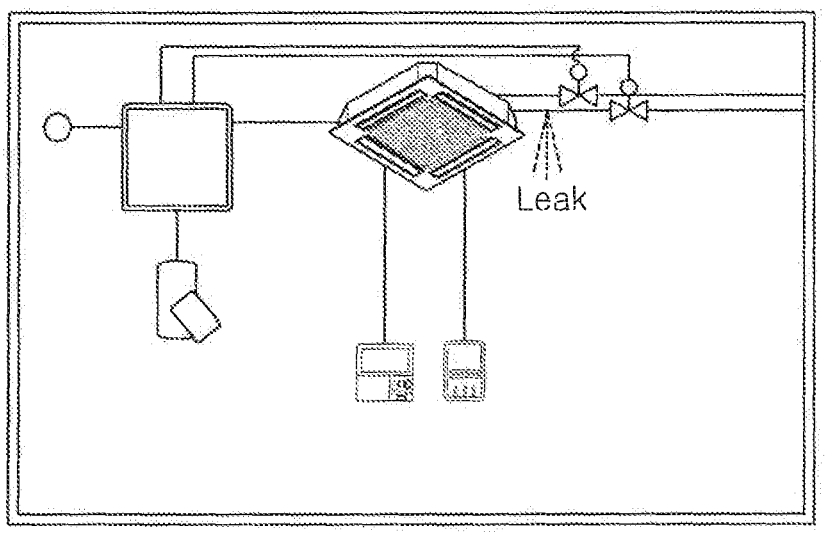
FIGS. 1A and 1B show a conventional air conditioning system including a refrigerant shut-off valve.

Advantages and features and a method of achieving the same will be clearly understood from embodiments described below with reference to the accompanying drawings. However, the embodiments are not limited to the following embodiments and may be implemented in various different forms. The embodiments are provided merely for complete disclosure and to fully convey the scope to those of ordinary skill in the art to which the embodiments pertain. The embodiments are defined only by the scope of the claims. Like reference numerals refer to like elements throughout the specification.

Spatially relative terms, such as "below," "beneath," "lower," "above," "upper" and the like, may be used herein for ease of description to describe one element's relationship to other elements as illustrated in the figures. It will be understood that the spatially relative terms are intended to encompass different orientations of the element in use or operation in addition to the orientation depicted in the figures. For example, if the element in the figures is turned over, elements described as "below" or "beneath" other elements would then be oriented "above" the other elements. Thus, the exemplary term "below" can encompass both an orientation of above and below. The element may be otherwise oriented, and the spatially relative descriptors used herein may be interpreted accordingly.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. The term "comprise" and/or "comprising" used herein specify the existence of stated components, steps, and/operations, but do not preclude the existence or addition of one or more components, steps, and/or operations thereof.

Unless otherwise defined, all terms (including technical and scientific terms) used herein have the same meanings as those commonly understood by one of ordinary skill in the art. It will be further understood that terms such as those defined in commonly used dictionaries should be interpreted as having meanings consistent with their meanings in the context of the relevant art and the present disclosure, and are not to be interpreted in an idealized or overly formal sense unless expressly so defined herein.

In the drawings, the thickness or size of each element may be exaggerated, omitted, or schematically illustrated for convenience of description and clarity. Also, the size or area of each element may not entirely reflect the actual size thereof.

Hereinafter, embodiments will be described below with reference to the accompanying drawings.

Figure 2:
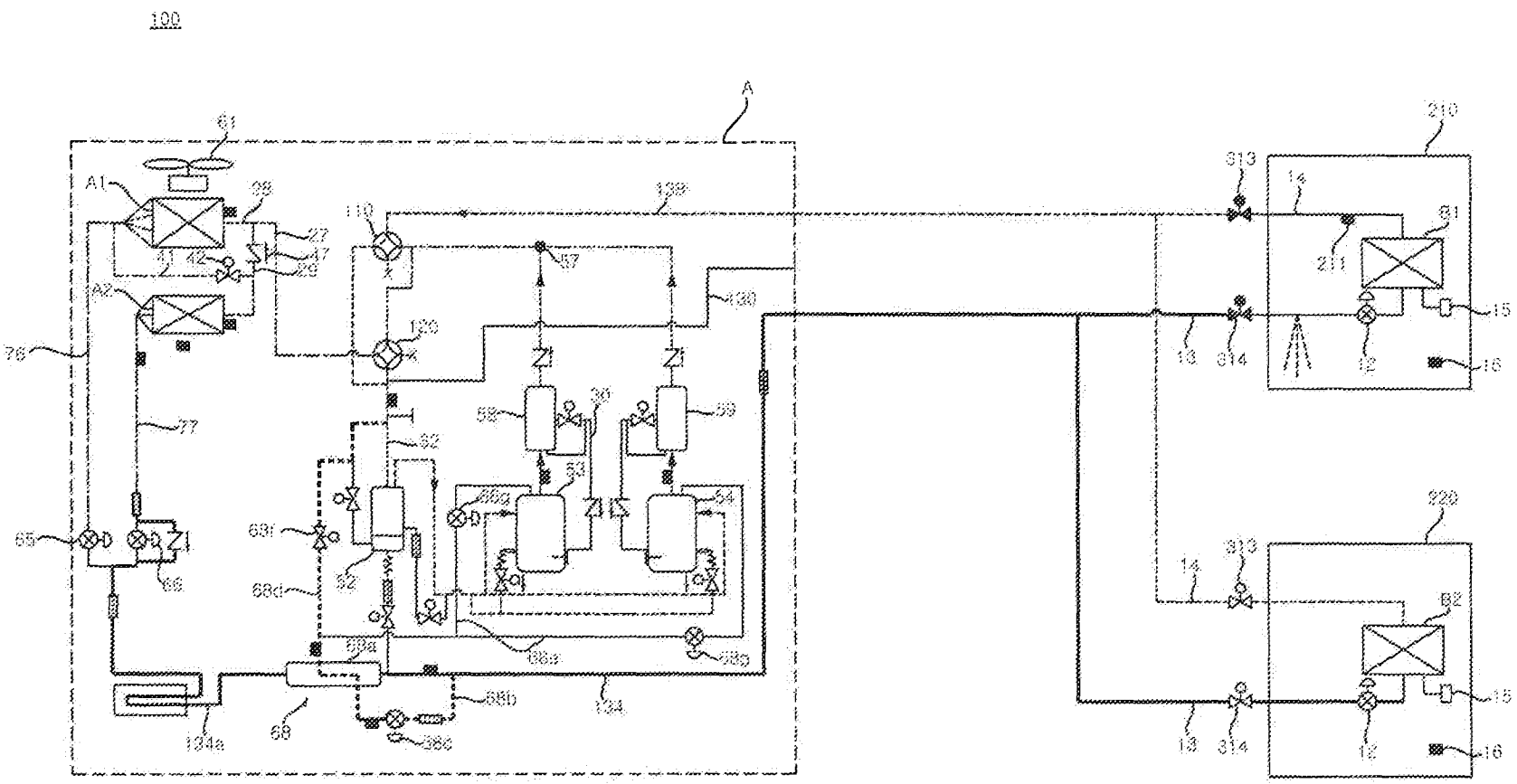
FIG. 2 is a schematic diagram of a multi-air conditioner for heating and cooling according to an embodiment.
Figure 3:
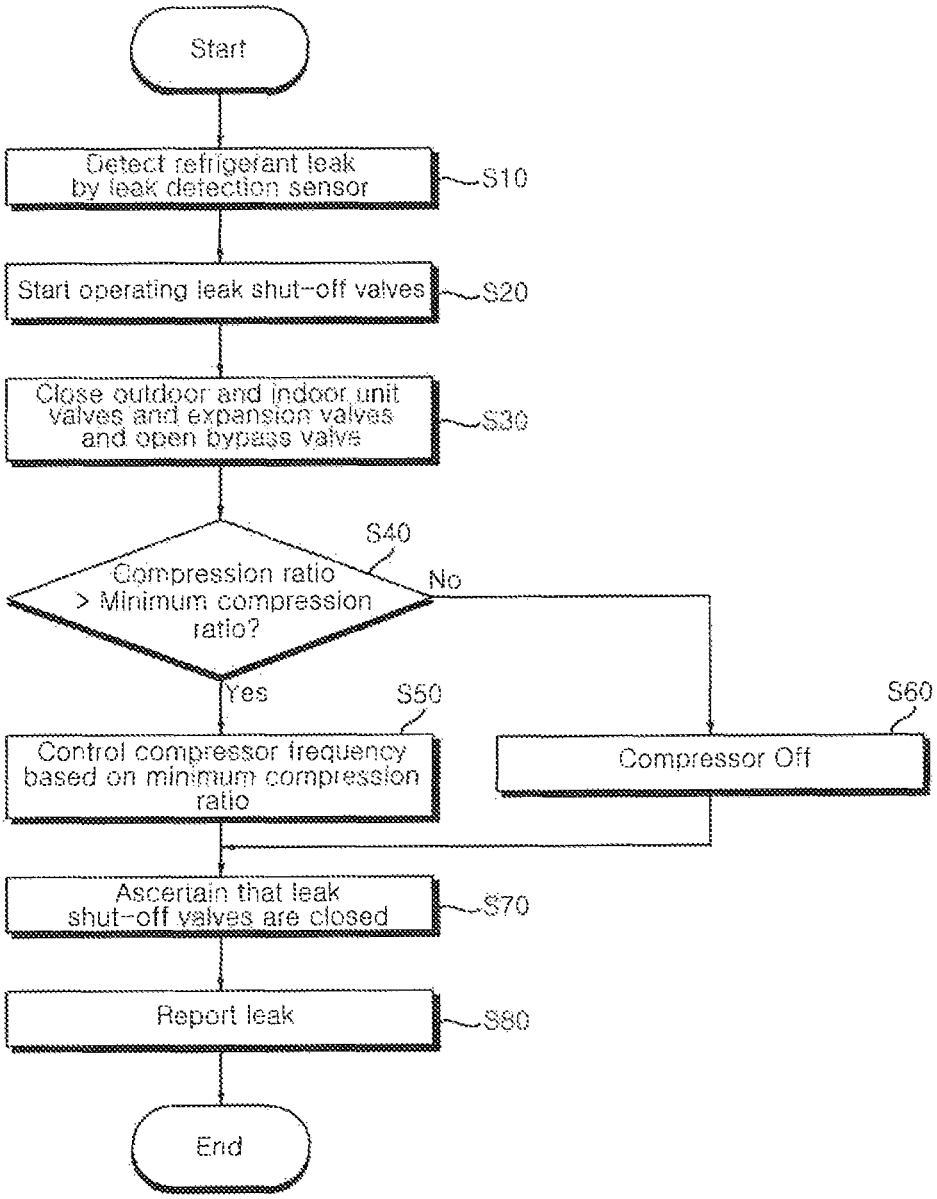
FIG. 3 is a flowchart of a switchable cooling operation of a multi-air conditioner for heating and cooling according to an embodiment.

FIG. 2 is a schematic diagram of a multi-air conditioner for heating and cooling according to an embodiment. FIG. 3 is a flowchart of a switchable cooling operation of a multi-air conditioner for heating and cooling according to an embodiment.

Referring to FIG. 2, multi-air conditioner 100 for heating and cooling according to an embodiment may include at least one indoor unit B (B1, B2) for both cooling and heating and an outdoor unit A for both cooling and heating. The outdoor unit A may include an outdoor unit casing (not shown), compressors 53 and 54, outdoor heat exchangers A1 and A2, an accumulator 52, four-way valves 110 and 120, oil separators 58 and 59, outdoor expansion valves 65 and 66, a hot gas unit (not shown), and a subcooling unit 68.

The outdoor unit casing may include a gas pipe valve to which a gas pipe connecting pipeline 138 is connected and a liquid pipe valve to which a liquid pipe connecting pipeline 134 is connected. Moreover, the outdoor unit casing according to this embodiment may have a common pipe 130 connected to it, for connection to a plurality of outdoor units or for simultaneous operation of a plurality of indoor units, and may further include a common pipe valve connected to the common pipe 130. The liquid pipe valve and the gas pipe valve may be connected via the indoor unit B, an indoor liquid pipe 13, and an indoor gas pipe 14 and allow a refrigerant in the outdoor unit A to circulate.

The compressor 53 and 54 may be, for example, inverter compressors capable of controlling an amount of refrigerant and a discharge pressure of refrigerant by adjusting operation frequency. The compressors according to this embodiment may include first compressor 53 and second compressor 54. The first compressor 53 and the second compressor 54 may be placed in parallel. Although this embodiment is described as having two compressors 53 and 54 as shown in FIG. 2, it should be understood that this is only an example and a different number of compressors 53 and 54 may be used.

Also, the compressors 53 and 54 may have different capacities. One of the compressors 53 and 54 may be an inverter compressor with a variable number of turns, and the other one may be a constant-speed compressor, for example.

A bypass unit (indicated by a dotted line) may be connected to the compressors 53 and 54, which allows excess oil to drain out of the compressors 53 and 54 if there is too much oil in the compressors 53 and 54. The bypass unit may include a plurality of bypass pipelines connected to the compressors 53 and 54 and a common pipeline that allows oil or refrigerant flowing along the bypass pipelines to combine. The common pipeline may be connected to an accumulator discharge pipeline 33.

The bypass pipelines may be connected to the compressors 53 and 54, at a position higher than, or the same as, a minimum oil level required for the compressors 53 and 54. Depending on the oil level in the compressors 53 and 54, refrigerant alone, oil alone, or both refrigerant and oil together may be discharged through the bypass pipelines. A pressure reducing portion that reduces a pressure of fluid discharged from the compressors 53 and 54 and a valve that reduces an amount of fluid flowing through the bypass pipes may be installed on the bypass pipelines.

The oil separators 58 and 59 may be disposed on discharge sides of the compressors 53 and 54. The oil separators 58 and 59 according to this embodiment may include a first oil separator 58 disposed on the discharge side of the first compressor 53 and a second oil separator 59 disposed on the discharge side of the second compressor 54. Refrigerant discharged from the compressors 53 and 54 may flow through the oil separators 58 and 59 to the four-way valves 110 and 120. The oil separators 58 and 59 collect oil contained in the discharged refrigerant and provide the collected oil back to the compressors 53 and 54.

The oil separators 58 and 59 may further include oil collecting pipes 30 and 31 that guide oil to the compressors 53 and 54 and check valves disposed on the oil collecting pipe 30 and 31 to allow refrigerant to flow in one direction. The oil separators 58 and 59 may be installed on a compressor discharge pipeline 34.

An oil collecting structure capable of collecting oil in the compressors 53 and 54 may be disposed on the accumulator 52 as well. An oil collecting pipeline that connects a lower side of the accumulator 52 and the accumulator discharge pipeline 33 and an oil return valve disposed on the oil collecting pipe to control the flow of oil may be provided.

In this embodiment, the outdoor heat exchangers A1 and A2 include first outdoor heat exchanger A1 and second outdoor heat exchanger A2. An outdoor blower fan 61 may be provided to improve heat exchange by the outdoor heat exchangers A1 and A2.

An outdoor heat exchanger-first four-way valve connecting pipeline 27 may be connected to the outdoor heat exchangers A1 and A2 to allow refrigerant to flow between the outdoor heat exchangers A1 and A2 and the first four-way valve 110. The outdoor heat exchanger-first four-way valve connecting pipeline 27 may include first outdoor heat exchanger-first four-way valve connecting pipeline 28 that connects the first outdoor heat exchanger A1 and the first four-way valve 110 and second outdoor heat exchanger-first four-way valve that connects pipeline 29 connecting the second outdoor heat exchanger A2 and the first four-way valve 110. The outdoor heat exchanger-first four-way valve connecting pipeline 27 connected to the first four-way valve 110 is branched into the first outdoor heat exchanger-first four-way valve connecting pipeline 28 and the second outdoor heat exchanger-first four-way valve connecting pipeline 29.

A check valve 47 may be disposed on the second outdoor heat exchanger-first four-way valve connecting pipeline 29, and the check valve 47 may stop refrigerant supplied from the outdoor heat exchanger-first four-way valve connecting pipeline 27 from entering the second outdoor heat exchanger-first four-way valve connecting pipeline 29.

Further, a variable path pipeline 41 may be provided to connect a first outdoor heat exchanger pipeline 76 and the second outdoor heat exchanger-first four-way valve connecting pipeline 29. A variable path valve 42 may be disposed on the variable path pipeline 41.

The variable path valve 42 may be selectively operated. When the variable path valve 42 is opened, refrigerant flowing along the first outdoor heat exchanger pipeline 76 may pass through the variable path pipeline 41 and the variable path valve 42 and then be guided to the first four-way valve 110.

In a heating operation, when the variable path valve 42 is closed, refrigerant supplied through the first outdoor heat exchanger pipeline 76 may flow to the first outdoor heat exchanger A1. In a cooling operation, when the variable path valve 42 is closed, refrigerant passed through the first outdoor heat exchanger A1 may flow through the first outdoor heat exchanger pipeline 76 to the liquid pipe connecting pipeline 134.

In the heating operation, the outdoor expansion valves 65 and 66 allow refrigerant flowing to the outdoor heat exchangers A1 and A2 to expand. In the cooling operation, the outdoor expansion valves 65 and 66 allow the refrigerant to pass through but not expand. The outdoor expansion valves 65 and 66 may be, for example, electronic expansion valves (EEV) capable of adjusting opening degrees in response to an input signal.

The outdoor expansion valves 65 and 66 may include first outdoor expansion valve 65 which expands the refrigerant flowing to the first outdoor heat exchanger A1, and second outdoor expansion valve 66 which expands the refrigerant flowing to the second outdoor heat exchanger A2. The first outdoor expansion valve 65 and the second outdoor expansion valve 66 may be connected to the liquid pipe connecting pipeline 134. In the heating operation, refrigerant condensed in the indoor unit B may be supplied to the first outdoor expansion valve 65 and the second outdoor expansion valve 66.

In order to be connected to the first outdoor expansion valve 65 and the second outdoor expansion valve 66, the liquid pipe connecting pipeline 134 is branched and then connected to the first outdoor expansion valve 65 and the second outdoor expansion valve 66. The first outdoor expansion valve 65 and the second outdoor expansion valve 66 are placed in parallel.

A pipeline that connects the first outdoor expansion valve 65 and the first outdoor heat exchanger A1 is defined as first outdoor heat exchanger pipeline 76. A pipeline that connects the second outdoor expansion valve 66 and the second outdoor heat exchanger A2 is defined as a second outdoor heat exchanger pipeline 77.

The accumulator 52 may hold and store refrigerant and provide the refrigerant to the compressors 53 and 54. The accumulator 52 may be disposed on suction sides of the compressors 53 and 54 and connected to the four-way valves 110 and 120.

The outdoor unit A according to this embodiment may further include a receiver. The receiver may store liquid refrigerant in order to adjust an amount of circulating refrigerant. The receiver may store the liquid refrigerant separately from liquid refrigerant stored in the accumulator 52. The receiver may supply refrigerant to the accumulator 52 if there is an insufficient amount of circulating refrigerant, and collect and store the refrigerant if there is a large amount of circulating refrigerant.

A pipeline that connects the outdoor expansion valves 65 and 66 and a subcooling heat exchanger 68*a*, which is a portion of the liquid pipe connecting pipeline 134, may be defined as a subcooling liquid pipe connecting pipeline 134*a*.

The four-way valves 110 and 120 may be provided on outlet sides of the compressors 53 and 54 and switch a direction of refrigerant flowing in the outdoor unit A. The four-way valves 110 and 120 may switch the direction of refrigerant discharged from the compressors 53 and 54 depending on whether the air conditioner 100 is in the cooling or heating operation.

The four-way valves 110 and 120 according to this embodiment may include first four-way valve 110 which sends refrigerant discharged from the compressors 53 and 54 to the outdoor heat exchangers A1 and A2 or sends refrigerant flowing in the outdoor heat exchangers A1 and A2 to the compressors 53 and 54 through the accumulator, and second four-way valve 120 which sends refrigerant discharged from the compressors 53 and 54 to the gas pipe connecting pipeline 138 or sends refrigerant introduced from the gas pipe connecting pipeline 138 to the compressors 53 and 54 through the accumulator 52. Moreover, during the heating operation, the first four-way valve 110 on a side of the outdoor unit A in the heating operation sends refrigerant introduced into the outdoor heat exchangers A1 and A2 to the compressors 53 and 54 and the gas pipe connecting pipeline 138.

The first four-way valve 110 and second four-way valve 120 according to this embodiment may be configured such that the refrigerant discharged from the compressors 53 and 54 passes through the four-way valves 110 and 120 in off mode and such that the refrigerant discharged from the compressors 53 and 54 does not pass through the four-way valves 110 and 120 in on mode. When the air conditioner 100 according to this embodiment is in the cooling operation, the first four-way valve 110 stays in on mode and the second four-way valve 120 stays in off mode. When the air conditioner 100 according to this embodiment is in the heating operation, the first four-way valve 110 stays in off mode and the second four-way valve 120 stays in on mode.

The air conditioner 100 according to this embodiment may include a hot gas unit (not shown) through which a portion of refrigerant compressed in the compressors 53 and 54 flows. The portion of the refrigerant compressed in the compressors 53 and 54 may pass through a hot gas bypass pipeline and enter the outdoor heat exchangers A1 and A2.

The hot gas unit may include a hot gas bypass pipeline that bypasses refrigerant and a hot gas valve. For example, a first hot gas bypass pipeline that connects the first outdoor heat exchanger pipeline 76 and the compressor discharge pipeline 34 may be provided, and one or a first end of the first hot gas bypass pipeline 102 may be connected to the first outdoor heat exchanger pipeline 76 and the other or a second end may be connected to the compressor discharge pipeline 34. A second hot gas bypass pipeline that connects the second outdoor heat exchanger pipeline 77 and the compressor discharge pipeline 34 may be provided, and one or a first end of the second hot gas bypass pipeline may be connected to the second outdoor heat exchanger pipeline 77 and the other or a second end may be connected to the compressor discharge pipeline 34.

A first hot gas valve may be disposed on the first hot gas bypass pipeline, and a second hot gas valve may be disposed on the second hot gas bypass pipeline. The hot gas valves may be, for example, solenoid valves which are capable of adjusting opening degrees, or may be on-off valves.

The first hot gas bypass pipeline and the second hot gas bypass pipeline may be connected to the compressor discharge pipeline 34, or may be joined together into a single pipeline which is then connected to the compressor discharge pipeline 34.

A subcooling unit 68 may be disposed on the liquid pipe connecting pipeline 134. The subcooling unit 68 include subcooling heat exchanger 68*a*; a subcooling bypass pipeline 68*b* bypassed from the liquid pipe connecting pipeline 134 and connected to the subcooling heat exchanger 68*a*; a subcooling expansion valve 68*c* disposed on the subcooling bypass pipe 68*b* to selectively expand refrigerant flowing therein; a subcooling-compressor connecting pipeline 68*e* that connects the subcooling heat exchanger 68*a* and the compressors 53 and 54; and a subcooling-compressor expansion valve 68*g* disposed on the subcooling-compressor connecting pipeline 68*e* to selectively expand refrigerant flowing therein.

The subcooling unit 68 according to this embodiment may further include an accumulator bypass pipeline 68*d* that connects the accumulator 52, the subcooling heat exchanger 68*a*, and the subcooling-compressor connecting pipeline 68*e*. The accumulator bypass pipeline 68*d* combines refrigerant in the accumulator 52 and subcooled refrigerant passed through the subcooling heat exchanger 68*a* together and provides them to the subcooling-compressor connecting pipeline 68*e*. The subcooling-compressor connecting pipeline 68*e* may be branched into first subcooling-compressor connecting pipeline 68*e* and second subcooling-compressor connecting pipeline 68*e*. A first subcooling-compressor expansion valve 68*g* may be installed on the first subcooling-compressor connecting pipeline 68*e*, and a second subcooling-compressor expansion valve 68*g* may be installed on the second subcooling-compressor connecting pipeline 68*e*. Further, a subcooling bypass valve 68*f* may be disposed on the accumulator bypass pipeline 68*d*.

The subcooling expansion valve 68*c* may expand liquid refrigerant in the accumulator 52 and provide it to the subcooling heat exchanger 68*a*, and the expanded refrigerant evaporates in the subcooling heat exchanger 68*a*, thereby cooling the subcooling heat exchanger 68*a*. Liquid refrigerant flowing to the outdoor heat exchangers A1 and A2 through the liquid pipe connecting pipeline 134 may be cooled as it passes through the subcooling heat exchanger 68*a*. The subcooling expansion valve 68*c* may be selectively operated and control a temperature of the liquid refrigerant.

When the subcooling expansion valve 68*c* is operated, the subcooling-compressor expansion valve 68*g* may be opened and the refrigerant may flow to the compressors 53 and 54. The subcooling bypass valve 68*f* may be selectively operated and provide the liquid refrigerant in the accumulator 52 to the subcooling-compressor expansion valve 68*g*.

The subcooling-compressor expansion valve 68*g* may be selectively operated and expand refrigerant to lower a temperature of the refrigerant supplied to the compressors 53 and 54. If the compressors 53 and 54 exceed a normal operating temperature range, the refrigerant expanded in the subcooling-compressor expansion valve 68*g* may evaporate in the compressors 53 and 54, thereby lowering a temperature of the compressors 53 and 54.

The air conditioner 100 according to this embodiment may further include a pressure sensor that measures a pressure of refrigerant, a temperature sensor that measures a temperature of refrigerant, and a strainer that removes debris in refrigerant flowing through a refrigerant pipe.

The air conditioner 100 according to this embodiment may include refrigerant pipelines 134 and 138 that connect outdoor unit A and indoor unit B, through which refrigerant flows, and common pipe 130 that connects a plurality of outdoor units A and a plurality of indoor units B. The refrigerant pipelines 134 and 138 may include liquid pipe connecting pipeline 134 through which liquid refrigerant flows, and gas pipe connecting pipeline 138 through which gas refrigerant flows. The liquid pipe connecting pipeline 134 and the gas pipe connecting pipeline 138 may extend inside of the outdoor unit A, and the common pipe 130 may also extend inside of the outdoor unit A.

Although at least one indoor unit B needs to be installed in an indoor space 200 and FIG. 2 illustrates two indoor units B1 and B2 for convenience of explanation, the number of indoor units is not limited to this example alone. One of the indoor units is marked a first indoor unit B1 and the other one is marked a second indoor unit B2. As the indoor units B1 and B2 have the same internal construction, description will be given with respect to the first indoor unit B1.

The indoor units B1 and B2 may be installed in respective indoor spaces 210 and 220 which are separated from each other, and each of the indoor units may include an indoor expansion valve 12 and an indoor heat exchanger B1 and B2 (designated by the same reference numerals as the indoor units) which are within an indoor unit casing (not shown).

In each indoor unit B1 and B2, the indoor expansion valve 12 and the indoor heat exchanger B1 and B2 may be connected to the refrigerant pipelines 13 and 14. Also, each indoor unit B1 and B2 may be connected in parallel with the refrigerant pipelines 13 and 14. Each indoor unit B1 and B2 may be installed in such a way that air in the indoor space 210 and 220 to be air-conditioned is drawn in to exchange heat in the indoor heat exchanger B1 and B2 and then discharged into the indoor space to be air-conditioned. An indoor fan (not shown) that blows indoor air into the indoor heat exchanger B may be installed on the indoor unit B.

As indoor refrigerant pipelines connected to the indoor unit B, the indoor liquid pipe 13 connected to the liquid pipe connecting pipeline 134 and the indoor gas pipe 14 connected to the gas pipe connecting pipeline 138 are provided in the indoor space 200 in which at least one indoor unit B is installed. Indoor expansion valve 12 is provided on the indoor liquid pipe 13 to direct refrigerant to the indoor heat exchanger B1 and B2.

Each indoor unit B1 and B2 may further include a controller 15 that receives a control command and a detection signal from the outside and transmits them to the outdoor unit A through wired/wireless communication. Moreover, a separate leak detection sensor 16 may be installed in the indoor space 200, spaced apart from the indoor unit B, in order to detect refrigerant leaks. The leak detection sensor 16 may periodically detect whether there is refrigerant in the indoor space and send a corresponding detection signal to the controller 15.

The air conditioner 100 according to an embodiment may further include shut-off valves 313 and 314 installed on the refrigerant pipelines 134 and 138 outside of the indoor space 210 and 220 in which the indoor unit B1 and B2 is installed, in order to reduce an amount of refrigerant leakage on the refrigerant pipelines 134 and 138 between the indoor space 200 with the indoor unit B installed therein and the outdoor unit A. The shut-off valves 313 and 314 may include gas pipe shut-off valve 313 which is installed on the gas pipe connecting pipeline 138 connected to the indoor gas pipe 14 and blocks the flow of refrigerant to the gas pipe connecting pipeline 138 if the refrigerant leaks in the indoor space 200, and liquid pipe shut-off valve 314 which is installed on the liquid pipe connecting pipeline 134 connected to the indoor liquid pipe 13 and blocks the flow of refrigerant to the liquid pipe connecting pipeline 134 if the refrigerant leaks in the indoor space 210 and 220.

Figure 1B:
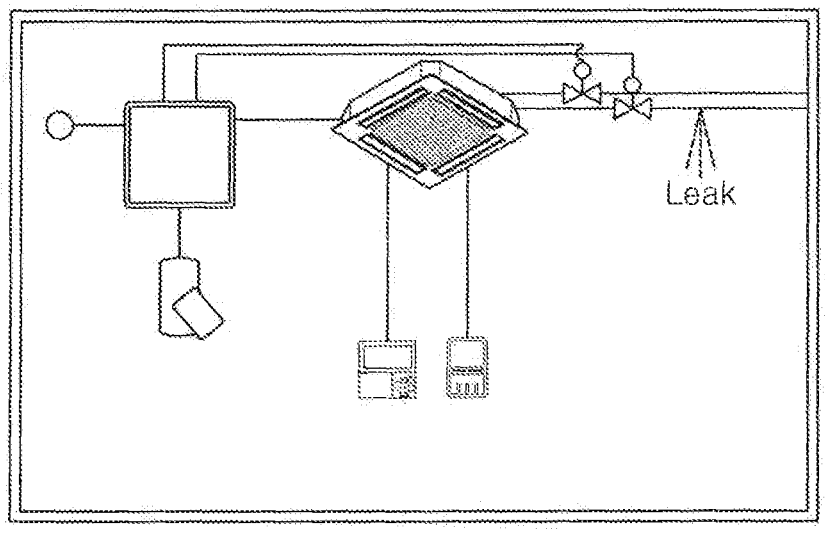

The gas pipe shut-off valve 313 and the liquid pipe shut-off valve 314 may be valves that block very large amounts of flow, and they may be, for example, SOL valves which take several tens of seconds or several minutes until they completely block flow after receiving a control signal. Thus, in a case in which the gas pipe shut-off valve 313 and the liquid pipe shut-off valve 314 are installed in an indoor space, if a leak occurs outside of the shut-off valves 313 and 314 in the indoor space as shown in FIG. 1B, it is not possible to stop refrigerant leaking from the outdoor unit A from entering the indoor space 200 even if the shut-off valves 313 and 314 are operated. Accordingly, the refrigerant shut-off valves 313 and 314 are provided on the refrigerant pipelines 134 and 138 outside of the indoor space 210 and 220 in which the indoor unit B1 and B2 is installed, in order to prevent leaking refrigerant from entering the indoor space in a case in which a leak occurs as shown in FIG. 1B. Even when the shut-off valves 313 and 314 are operated due to the refrigerant leak occurring in the indoor space 210 and 220, refrigerant leak control may be performed in order to prevent the refrigerant in the refrigerant pipelines 134, 138, 13, and 14 from continuing to leak to the indoor space 210 and 220 while the shut-off valves 313 and 314 are completely closed.

Referring to FIGS. 2 and 3, refrigerant leak control during a cooling operation of a switchable air conditioner according to an embodiment will be described hereinafter.

FIG. 3 is a flowchart of refrigerant leak control of a multi-air conditioner for heating and cooling according to an embodiment. When the indoor unit B1 and B2 is operated in a switchable cooling mode, the indoor fan rotates at a set or predetermined air speed and the indoor expansion valve 12 is opened to control target superheat. When the indoor unit B1 and B2 is stopped, the indoor fan is stopped and the indoor expansion valve 12 is closed.

In the cooling mode, the first outdoor heat exchanger A1 and the second outdoor heat exchanger A2 have the same connections between components. The outdoor heat exchangers A1 and A2 are both used as condensers. The outdoor expansion valves 65 and 66 are opened to a maximum.

A refrigerant flowing through the outdoor heat exchangers A1 and A2 is a high-temperature, high-pressure refrigerant discharged from the compressors 53 and 54, and outdoor blower fan 61 performs target high pressure control. The first four-way valve 110 is set to an ON mode in which the refrigerant discharged from the compressors 53 and 54 does not pass through the first four-way valve 110. The second four-way valve 120 is set to an OFF mode in which the refrigerant discharged from the compressors 53 and 54 passes through the second four-way valve 120. That is, the second four-way valve 120 connects the compressor discharge pipeline 34 and the outdoor heat exchanger-first four-way valve connecting pipeline 27. The first four-way valve 110 sends gas refrigerant coming from the gas pipe connecting pipeline 138 to the compressors 53 and 54. That is, the first four-way valve 110 connects the gas pipe connecting pipeline 138 and an accumulator inlet pipeline 32. In the cooling mode, the liquid pipe valve and the gas pipe valve are opened, and the common pipe valve is closed.

The flow of refrigerant will be described. Refrigerant discharged from the compressors 53 and 54 flows to the outdoor heat exchangers A1 and A2 through the second four-way valve 120. The refrigerant condensed in the outdoor heat exchangers A1 and A2 flows through the liquid pipe connecting pipeline 134 and passes through a buffer unit C. The refrigerant is introduced into the indoor liquid pipe 13 of the indoor space 200 through the liquid pipe connecting pipeline 134, flows to the indoor unit B and evaporates, and then flows to the indoor gas pipe 14. The refrigerant flowing to the indoor gas pipe 14 flows to the first four-way valve 110 along the gas pipe connecting pipeline 138 and enters the compressor 53 and 54 past the accumulator 52.

When a refrigerant leak is detected in this flow, a refrigerant leak detection operation is executed as in FIGS. 2 and 3. More specifically, during the cooling operation, if a leak occurs in any of the liquid pipes 134 and 13 when high-temperature, high-pressure liquid refrigerant condensed in the outdoor unit A is introduced into the indoor unit B1 and B2 and turns into low-pressure gas through the expansion valve 12 in the indoor unit B1 and B2, the leak detection sensor 16 installed in the indoor space 210 and 220 detects the leak first and then transmits a detection signal to the controller 15 of the indoor unit B (S10).

Once the controller 15 of the indoor unit B transmits the corresponding detection signal to a controller (not shown) of the outdoor unit A via outdoor unit-indoor unit communication, the controller of the outdoor unit A then starts a refrigerant leak detection operation. Upon receiving a leak detection signal, the controller closes the refrigerant shut-off valves 313 and 314 to block the flow of refrigerant flowing through the refrigerant pipelines 13 and 14 (S20).

In this instance, the liquid pipe shut-off valve 314 and the gas pipe shut-off valve 313 are closed at the same time, and it takes 90 to 120 seconds for the liquid pipe shut-off valve 314 and the gas pipe shut-off valve 313 to close. In order to prevent refrigerant flowing in the liquid pipe connecting pipeline 134 from continuing to leak to the indoor space 200 during such a relatively long period of time, the controller performs an operation for lowering the pressure of the liquid pipe connecting pipeline 134 in which a high-pressure refrigerant flows.

More specifically, the first outdoor expansion valve 65 and the second outdoor expansion valve 66 are closed, and the subcooling expansion valve 68*c* and subcooling bypass valve 68*f* of the subcooling unit 68 are opened at the same time (S30). Once the first outdoor expansion valve 65 and the second outdoor expansion valve 66 are closed, condensed refrigerant passed through the outdoor heat exchangers is introduced into the liquid pipe connecting pipeline 134 as its flow rate decreases abruptly through the bypass pipelines.

At this point, the high-pressure refrigerant in the liquid pipe connecting pipeline 134 is bypassed to the subcooling bypass pipeline 68*b* and bypassed through the accumulator bypass pipeline 68*d*. In this instance, the subcooling expansion valve 68*c* and the subcooling bypass valve 68*f* may be solenoid valves and have a faster response speed than the shut-off valves 313 and 314.

Thus, a low-pressure output of the accumulator 52 is connected through a bypass to the liquid pipe connecting pipeline 134 connected to the indoor liquid pipe 13. Accordingly, the low pressure output is instantaneously bypassed to the high-pressure liquid pipe connecting pipeline 134, thereby making the pressure in that pipeline very low. Once the pressures at the liquid pipe connecting pipeline 134 and the indoor liquid pipe 13 are lowered, the amount of refrigerant flowing through the pipelines 134 and 13 decreases abruptly while the shut-off valves 313 and 314 are closed, resulting in a significant reduction in the amount of refrigerant leakage flowing indoors.

The controller may measure a compression ratio of the compressors 53 and 54, and if the compression ratio is higher than a minimum compression ratio (S40), the controller may control the compressors 53 and 54 such that their operating frequency is maintained or decreased. In this instance, a rate of increase in power or current consumption of the air conditioner 100 may be relatively low (S50).

If the compression ratio of the compressors 53 and 54 is lower than or equal to the minimum compression ratio (S60), it means that the low pressure at inputs of the compressors 53 and 54 is very high. From this, it can be inferred that the shut-off valves 313 and 314 are completely shut off when the pressures at the liquid pipe connecting pipeline 134 and the output of the accumulator 52, which are connected through a bypass, have risen to a similar level. Accordingly, the system is stopped by stopping the compressors 53 and 54 (S60).

Next, if the controller receives a corresponding detection signal after ascertaining that the leak shut-off valves 313 and 314 are completely closed (S70), the controller reports the occurrence of the refrigerant leak to the user or a person in charge by sending a repair request, and re-starts operating the compressors 53 and 54 for the cooling operation of another indoor unit, that is, the indoor unit B2 in the indoor space 220 where no leak has occurred (S80).

In this way, when using the refrigerant shut-off valves 313 and 314 in the case of a refrigerant leak, the refrigerant shut-off valves 313 and 314 may be provided at a position outside of the indoor space 200, thereby minimizing the amount of refrigerant remaining in the indoor space 200. Also, in order to reduce the amount of leakage until the shut-off valves 313 and 314 are completely shut off, the low pressure at the output of the accumulator 52, that is, inputs of the compressors 53 and 54 may be bypassed to the refrigerant pipelines 314 and 13, thereby significantly reducing the amount of refrigerant leaking.

Figure 4:
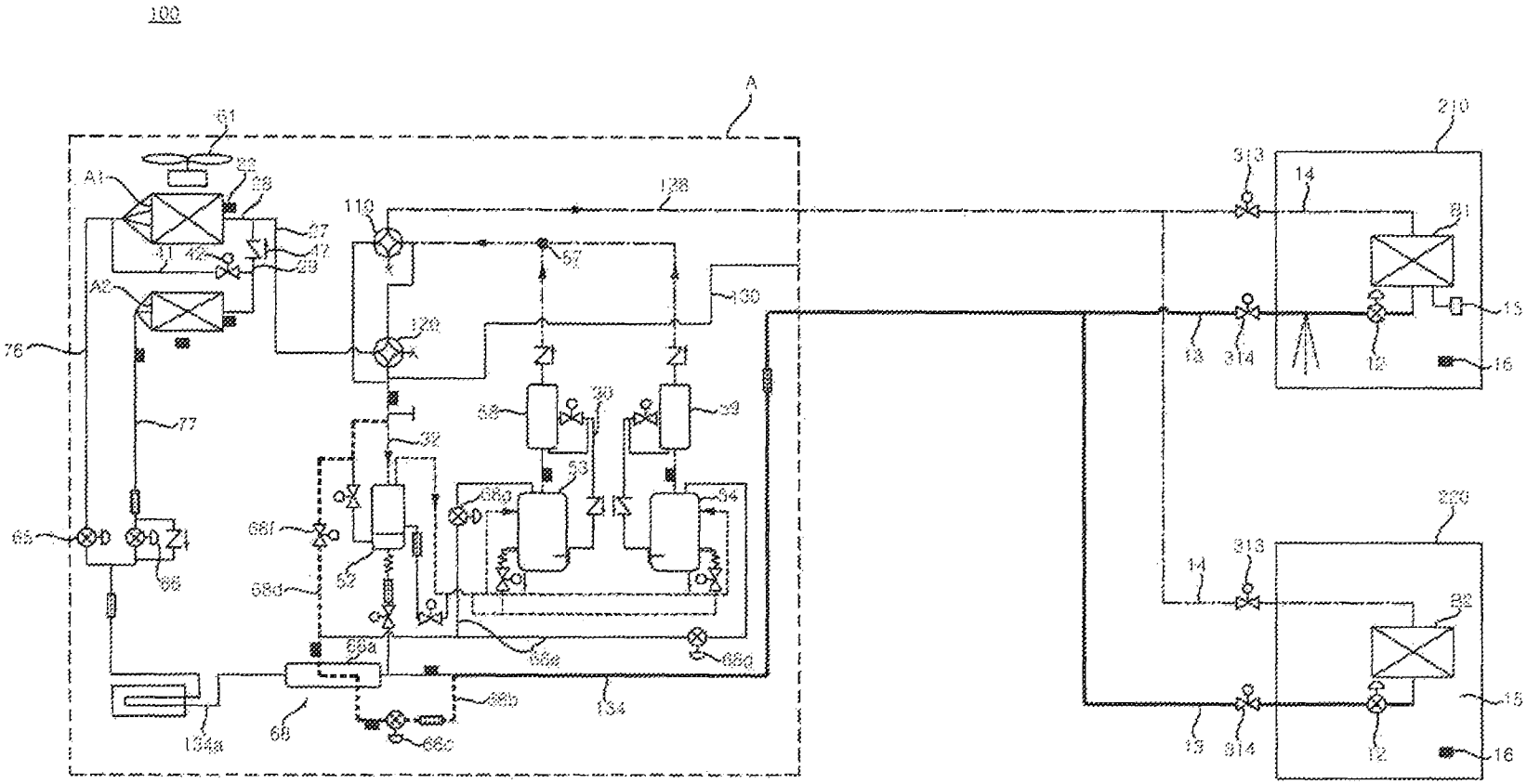
FIG. 4 is a view of a switchable heating operation of a multi-air conditioner for heating and cooling according to an embodiment.

FIG. 4 is a view of a switchable heating operation of a multi-air conditioner for heating and cooling according to an embodiment. When the indoor unit B is operated in the heating mode of the switchable air conditioner 100, the indoor fan rotates at a set or predetermined air speed and the indoor expansion valve 12 is opened to control target superheat. When the indoor unit B1 and B2 is stopped, the indoor fan may be stopped, and the indoor expansion valve 12 may be stopped to prevent liquid pooling.

In the heating mode, the first outdoor heat exchanger A1 and the second outdoor heat exchanger A2 have the same connections between components. The outdoor heat exchangers A1 and A2 are both used as evaporators. The outdoor expansion valves 65 and 66 are opened to a maximum.

In the heating mode, the compressors 53 and 54 perform target high-pressure control. In the heating mode, the high pressure of the cycle has an important effect on heating performance. Thus, the operating frequency of the compressors 53 and 54 may be determined in such a way that the high pressure is within a set or predetermined pressure range.

The high pressure may go up when the operating frequency of the compressors 53 and 54 is increased, and the high pressure may go down when the operating frequency is decreased. In a case in which the compressors 53 and 54 are operated at a predetermined operating frequency during initial start-up, if a rate of increase in high pressure is lower than a preset or predetermined rate of increase, the operating frequency of the compressors 53 and 54 may be increased. If the rate of increase in high pressure is lower than a preset or predetermined rate of increase in the process in which the operating frequency of the compressors 53 and 54 is increased, a rate of increase in operating frequency of the compressors 53 and 54 may increase over time. In this case, the rate of increase in power or current consumption of the air conditioner 100 may be relatively high.

Refrigerant flowing through the outdoor heat exchangers A1 and A2 is low-pressure refrigerant introduced into the compressors 53 and 54, and the outdoor blower fan 61 performs target low-pressure control. The second four-way valve 120 is set to an ON mode in which the refrigerant discharged from the compressors 53 and 54 does not pass through the second four-way valve 120. The first four-way valve 110 is set to an OFF mode in which the refrigerant discharged from the compressors 53 and 54 passes through the first four-way valve 110. The second four-way valve 120 connects the outdoor heat exchangers A1 and A2 and the compressors 53 and 54. That is, the second four-way valve 120 connects the outdoor heat exchanger-first four-way valve connecting pipeline 27 and the accumulator inlet pipeline 32, so that the refrigerant discharged from the outdoor heat exchangers A1 and A2 flows to the compressors 53 and 54 through the accumulator 52. The first four-way valve 110 sends refrigerant discharged from the compressors 53 and 54 to the gas pipe connecting pipeline 138 connected to the indoor unit B. That is, the first four-way valve 110 connects the compressor discharge pipeline 34 and the gas pipe connecting pipeline 138.

In the heating mode, the liquid pipe valve and the gas pipe valve are opened, and the common pipe valve is closed. Accordingly, refrigerant does not flow into the common pipe 130.

The flow of refrigerant in the heating mode will be described. Refrigerant discharged from the compressors 53 and 54 flows to the gas pipe connecting pipeline 138 through the first four-way valve 110. The refrigerant flowing through the gas pipe connecting pipeline 138 flows to the indoor unit B1 and B2 and condenses. The refrigerant condensed in the indoor unit B1 and B2 is introduced into the outdoor unit A through the indoor liquid pipe 13 and the liquid pipe connecting pipeline 134. The refrigerant introduced into the outdoor unit A flows to the outdoor heat exchangers A1 and A2 through the outdoor expansion valves 65 and 66. The refrigerant evaporated in the outdoor heat exchangers A1 and A2 flows to the second four-way valve 120, and flows to the compressors 53 and 54 through the accumulator 52.

When a refrigerant leak is detected in this flow, a refrigerant leak detection operation is executed as in FIG. 4. More specifically, during the heating operation, if a leak occurs in any of the liquid pipes 134 and 13, the controller 15 of the indoor unit B transmits a corresponding detection signal to a controller (not shown) of the outdoor unit A via outdoor unit-indoor unit communication first, and then the controller of the outdoor unit A starts a refrigerant leak detection operation.

Upon receiving a leak detection signal, the controller closes the refrigerant shut-off valves 313 and 314 to block the flow of refrigerant flowing through the refrigerant pipelines 13 and 14 (S20). In this instance, the liquid pipe shut-off valve 314 and the gas pipe shut-off valve 313 are closed at the same time, and it takes 90 to 120 seconds for the liquid pipe shut-off valve 314 and the gas pipe shut-off valve 313 to close. In order to prevent refrigerant flowing in the liquid pipe connecting pipeline 134 from continuing to leak to the indoor space 200 during such a relatively long period of time, the controller performs an operation for lowering the pressure of the liquid pipe connecting pipeline 134 in which a high-pressure refrigerant flows.

More specifically, the first outdoor expansion valve 65 and the second outdoor expansion valve 66 are closed, and the subcooling expansion valve 68*c* and subcooling bypass valve 68*f* of the subcooling unit 68 are opened at the same time (S30). Once the first outdoor expansion valve 65 and the second outdoor expansion valve 66 are closed, refrigerant passed through the subcooling unit 68 does not pass through the first outdoor expansion valve 65 and the second outdoor expansion valve 66 and does not flow to the outdoor heat exchangers A1 and A2.

Moreover, the subcooling expansion valve 68*c* and subcooling bypass valve 68*f* of the subcooling unit 68 are opened at the same time, so that the high-pressure refrigerant in the liquid pipe connecting pipeline 134 is bypassed to the subcooling bypass pipeline 68*b* and bypassed through the accumulator bypass pipeline 68*d*. In this instance, the subcooling expansion valve 68*c* and the subcooling bypass valve 68*f* may be solenoid valves and have a faster response speed than the shut-off valves 313 and 314.

Thus, a low-pressure output of the accumulator 52 is connected through a bypass to the liquid pipe connecting pipeline 134 connected to the indoor liquid pipe 13. Accordingly, the low pressure output is instantaneously bypassed to the high-pressure liquid pipe connecting pipeline 134, thereby making the pressure in that pipeline very low. Once the pressures at the liquid pipe connecting pipeline 134 and the indoor liquid pipe 13 are lowered, the amount of refrigerant flowing through the pipelines 134 and 13 decreases abruptly while the shut-off valves 313 and 314 are being closed, resulting in a significant reduction in the amount of refrigerant leakage flowing indoors.

The controller may measure the compression ratio of the compressors 53 and 54, and if the compression ratio is higher than a minimum compression ratio (S40), the controller may control the compressors 53 and 54 such that their operating frequency is maintained or decreased. In this instance, the rate of increase in power or current consumption of the air conditioner 100 may be relatively low (S50).

If the compression ratio of the compressors 53 and 54 is lower than or equal to the minimum compression ratio (S60), it means that the low pressure at inputs of the compressors 53 and 54 is very high. From this, it can be inferred that the shut-off valves 313 and 314 are completely shut off when the pressures at the liquid pipe connecting pipeline 134 and the output of the accumulator 52, which are connected through a bypass, have risen to a similar level. Accordingly, the system is stopped by stopping the compressors 53 and 54 (S60).

Next, if the controller receives a corresponding detection signal after ascertaining that the leak shut-off valves 313 and 314 are completely closed (S70), the controller reports the occurrence of the refrigerant leak to the user or the person in charge by sending a repair request (S80). In this way, when using the refrigerant shut-off valves 313 and 314 in the case of a refrigerant leak, the refrigerant shut-off valves 313 and 314 may be located at a position outside of the indoor space 200, thereby minimizing the amount of refrigerant remaining in the indoor space 200. Also, in order to reduce the amount of leakage until the shut-off valves 313 and 314 are completely shut off, the amount of refrigerant in the pipelines 314 and 13 may be reduced, and at the same time, the low pressure at the output of the accumulator 52, that is, the inputs of the compressors 53 and 54 is bypassed to the refrigerant pipelines 314 and 13, thereby significantly reducing the amount of refrigerant leaking.

Hereinafter, refrigerant leak control during simultaneous cooling and heating operations of a multi-air conditioner according to another embodiment will be described.

Figure 5:
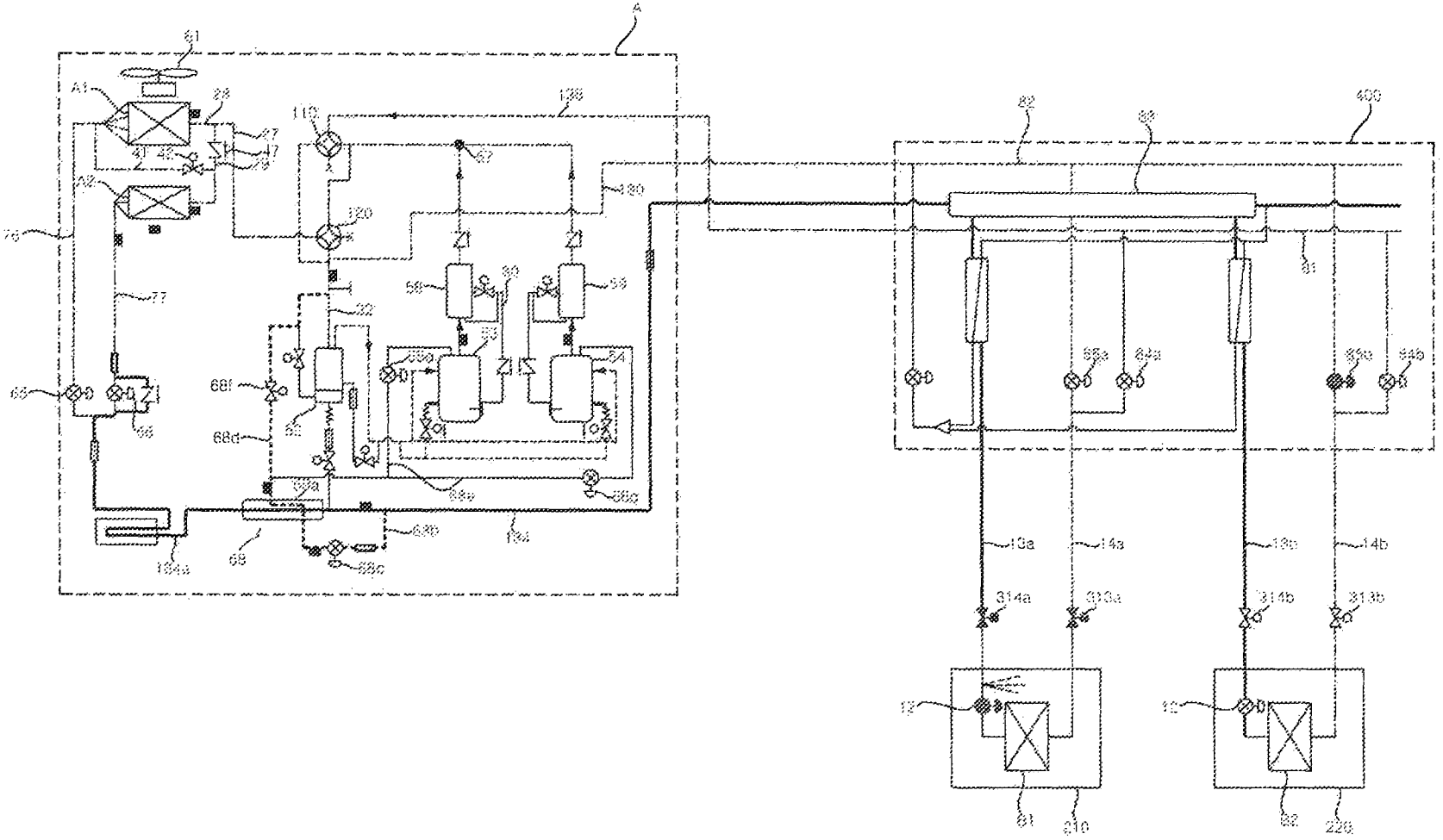
FIG. 5 is a view of a simultaneous cooling-only operation of a multi-air conditioner for heating and cooling according to another embodiment.
Figure 6:
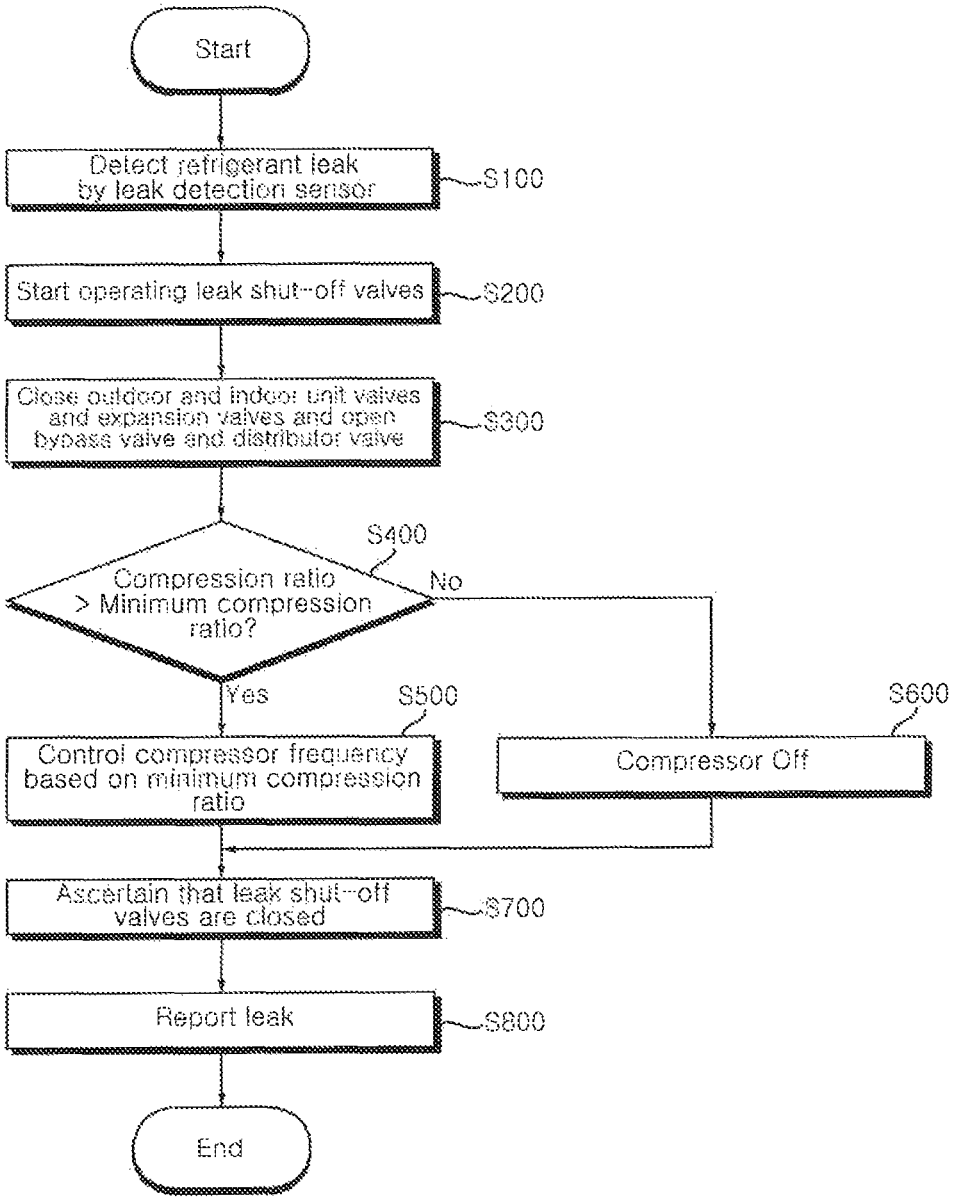
FIG. 6 is a flowchart of a simultaneous cooling operation of a multi-air conditioner for heating and cooling according to another embodiment.

FIG. 5 is a view of a simultaneous cooling-only operation of a multi-air conditioner for heating and cooling according to another embodiment. FIG. 6 is a flowchart of a simultaneous cooling operation of a multi-air conditioner for heating and cooling according to another embodiment.

Referring to FIGS. 5 and 6, the multi-air conditioner for heating and cooling according to another embodiment may include at least one indoor unit B for both cooling and heating, an outdoor unit A for both cooling and heating, and a distributor 400. The configuration of the at least one indoor unit B, the outdoor unit A, and the buffer unit C may be identical to the embodiment of FIG. 2, except that the simultaneous air conditioner further includes a distributor 400 between the indoor units B and the outdoor unit A. In this case, the common pipe 130 is connected as a low-pressure connecting pipeline to the distributor 400, unlike in FIG. 2.

The distributor 400 may be disposed between the outdoor unit A and the at least one indoor unit B1 and B2, and distribute refrigerant to the indoor units B1 and B2 according to conditions for a cooling or heating operation. Although a plurality of indoor units may be connected according to embodiment, FIG. 5 illustrates two indoor units B1 and B2 for convenience of explanation.

The distributor 400 may include a high-pressure gas header 81, a low-pressure gas header 82, a liquid header 83, and control valves 84 and 85. The indoor electronic expansion valves 12 of the indoor units may be installed on indoor connecting pipelines 13*a* and 13*b* that connect the indoor heat exchangers B1 and B2 and the high-pressure gas header 81.

The high-pressure gas header 81 may be connected to the gas pipe connecting pipeline 138 of a joint 57 and one or a first side of the indoor units B1 and B2. The low-pressure gas header 82 may be connected to the common pipe 130 and the other or a second side of the indoor units B1 and B2. The liquid header 83 may be connected to the subcooling unit 68 and the first side of the indoor units B1 and B2. Further, the high-pressure gas header 81, the low-pressure gas header 82, and the liquid header 83 may be connected to respective pipelines of another outdoor unit (not shown). Low-pressure valves 84*a* and 84*b* may be provided on the indoor gas pipes 14*a* and 14*b* so as to be connected to the low-pressure gas header 82, and high-pressure valves 85*a* and 85*b* may be provided on the indoor gas pipes 14*a* and 14*b* so as to be connected to the high-pressure gas header 81. Further, a bypass pipeline (not shown) may be installed between the low-pressure valves 84*a* and 84*b* and the high-pressure valves 85*a* and 85*b*.

When all of the indoor units B are in the cooling mode as shown in FIG. 5, high-temperature, high-pressure refrigerant compressed in the compressors 53 and 54 may be further condensed as it flows through the outdoor heat exchangers A1 and A2. The first four-way valve 110 may be set to the OFF mode in which refrigerant discharged from the compressors 53 and 54 passes through the first four-way valve 110. The second four-way valve 120 is set to the OFF mode in which the refrigerant discharged from the compressors 53 and 54 passes through the second four-way valve 120. That is, the second four-way valve 120 connects the compressor discharge pipeline 34 and the outdoor heat exchanger-first four-way valve connecting pipeline 27. The first four-way valve 110 directs a portion of the compressed refrigerant from the compressor discharge pipeline 34 to the gas pipe connecting pipeline 138. The accumulator inlet pipeline 32 is branched to the common pipe 130, and a portion of the refrigerant flows to the accumulator inlet pipeline 32 through the common pipe 130. In the cooling mode, the liquid pipe valve, the gas pipe valve, and the common pipe valve are also opened.

A flow of refrigerant will be described. Refrigerant discharged from the compressors 53 and 54 flows to the outdoor heat exchangers A1 and A2 through the second four-way valve 120. The refrigerant condensed in the outdoor heat exchangers A1 and A2 flows through the liquid pipe connecting pipeline 134 into the indoor liquid pipe 13*a* and 13*b* of the indoor space 210 and 220 and then flows to the indoor unit B and evaporates. Next, the refrigerant flows to the indoor gas pipe 14*a* and 14*b*, collects at the low-pressure header 82 as the low-pressure valve 84 of the distributor is opened, and then flows to the common pipe 130. The refrigerant flowing to the common pipe 130 is introduced into the compressors 53 and 54 through the accumulator 52.

In this instance, refrigerant may leak from the liquid pipes 13*a*, 13*b*, and 134. When a refrigerant leak is detected in this flow, a refrigerant leak detection operation is executed as in FIG. 6.

If a leak occurs in any of the liquid pipes 134, 13*a*, and 13*b*, the leak detection sensor 16 installed in the indoor space 210 and 220 detects the leak first and then transmits a detection signal to the controller 15 of the indoor unit B1 and B2 (S100).

More specifically, during the cooling operation, if a leak occurs in any of the liquid pipes 134 and 13*a* and gas pipe 14*a* of a particular indoor space 210 when high-temperature, high-pressure liquid refrigerant condensed in the outdoor unit A is introduced into the indoor unit B1 and B2 and turns into low-pressure gas through the expansion valve 12 in the indoor unit B1 and B2, the leak detection sensor 16 installed in the indoor space 210 and 220 detects the leak first and then transmits a detection signal to the controller 15 of the indoor unit B1 (S100).

Once the controller 15 of the indoor unit B1 transmits the corresponding detection signal to a controller (not shown) of the outdoor unit A via outdoor unit-indoor unit communication, the controller of the outdoor unit A then starts a refrigerant leak detection operation. Upon receiving a leak detection signal, the controller closes the refrigerant shut-off valves 313*a* and 314*a* of the corresponding indoor space 210 to block the flow of refrigerant flowing through the refrigerant pipelines 13*a* and 14*a* (S200).

In this instance, the liquid pipe shut-off valve 314*a* and the gas pipe shut-off valve 313*a* are closed at the same time, and it takes 90 to 120 seconds for the liquid pipe shut-off valve 314*a* and the gas pipe shut-off valve 313*a* to close. In order to prevent refrigerant flowing in the liquid pipe connecting pipeline 134 from continuing to leak into the indoor space 200 during such a relatively long period of time, the controller performs an operation for lowering the pressure of the liquid pipe connecting pipeline 134*a* in which high-pressure refrigerant flows.

More specifically, the first outdoor expansion valve 65 and the second outdoor expansion valve 66 are closed, and the indoor expansion valve 12 of the corresponding indoor space 210 is also shut off, thereby abruptly decreasing the flow of refrigerant. Also, the low-pressure control valve 84*a* and high-pressure control valve 85*a* of the distributor 400 connected to the indoor unit B1 of the corresponding indoor space 210 are both opened, so that the gas refrigerant flowing through the two valves are mixed, whereby the gas refrigerant is stopped from flowing to the indoor heat exchanger B1. Moreover, if a leak occurs in the indoor gas pipe 14*a*, low and high pressure refrigerant is bypassed, which may significantly reduce the pressure of the pipeline where the leak has occurred and therefore lead to a reduction in refrigerant leak.

The subcooling expansion valve 68*c* and subcooling bypass valve 68*f* of the subcooling unit 68 are opened at the same time (S300). Once the first outdoor expansion valve 65 and the second outdoor expansion valve 66 are closed, condensed refrigerant passed through the outdoor heat exchangers A1 and A2 is introduced into the liquid pipe connecting pipeline 134 as its flow rate decreases abruptly through the bypass pipelines.

At this point, the high-pressure refrigerant in the liquid pipe connecting pipeline 134 is bypassed to the subcooling bypass pipeline 68*b* and bypassed through the accumulator bypass pipeline 68*d*. In this instance, the low pressure control valve 84*a*, the high-pressure control valve 85*a*, the subcooling expansion valve 68*c*, and the subcooling bypass valve 68*f* may be solenoid valves and have a faster response speed than the shut-off valves 313*a* and 314*a*. Thus, a low-pressure output of the accumulator 52 is connected through a bypass to the liquid pipe connecting pipeline 134 connected to the indoor liquid pipe 13. Accordingly, the low pressure output is instantaneously bypassed to the high-pressure liquid pipe connecting pipeline 134, thereby making the pressure in that pipeline very low. Once the pressures at the liquid pipe connecting pipeline 134 and the indoor liquid pipe 13 are lowered, the amount of refrigerant flowing through the pipelines 134 and 13 decreases abruptly while the shut-off valves 313*a* and 314*a* are closed, resulting in a significant reduction in the amount of refrigerant leakage flowing indoors.

The controller may measure the compression ratio of the compressors 53 and 54, and if the compression ratio is higher than a minimum compression ratio (S400), the controller may control the compressors 53 and 54 such that their operating frequency is maintained or decreased. In this instance, the rate of increase in power or current consumption of the air conditioner 100 may be relatively low (S500).

If the compression ratio of the compressors 53 and 54 is lower than or equal to the minimum compression ratio (S600), it means that the low pressure at inputs of the compressors 53 and 54 is very high. From this, it can be inferred that the shut-off valves 313*a* and 314*a* are completely shut off when the pressures at the liquid pipe connecting pipeline 134 and the output of the accumulator 52, which are connected through a bypass, have risen to a similar level. Accordingly, the system is stopped by stopping the compressors 53 and 54 (S600).

Next, if the controller receives a corresponding detection signal after ascertaining that the leak shut-off valves 313*a* and 314*a* are completely closed and (S700), it reports the occurrence of the refrigerant leak to the user or the person in charge by sending a repair request, and re-starts operating the compressors 53 and 54 for the cooling operation of another indoor unit, that is, the indoor unit B2 in the indoor space 220 where no leak has occurred (S800). In this way, when using the refrigerant shut-off valves 313*a*, 314*a*, 313*b*, and 314*b* in the case of a refrigerant leak, the refrigerant shut-off valves 313*a*, 314*a*, 313*b*, and 314*b* may be located in a position outside of the indoor space 210 and 220, thereby minimizing the amount of refrigerant remaining in the indoor space 210 and 220. In this instance, the amount of refrigerant flowing within the system may be significantly reduced by closing every expansion valve in the first place, and then, in order to reduce the amount of leakage until the shut-off valves 313*a*, 314*a*, 313*b*, and 314*b* are completely shut off, both the low-pressure control valve 84*a* and the high-pressure control valve 85*a* may be opened to connect a low-pressure gas pipe and a high-pressure gas pipe through a bypass, in case a leak occurs in the indoor gas pipe, or the low pressure at the inputs of the compressors 53 and 54 may be bypassed to the refrigerant pipelines 314 and 13, thereby significantly reducing the amount of refrigerant leaking.

Figure 7:
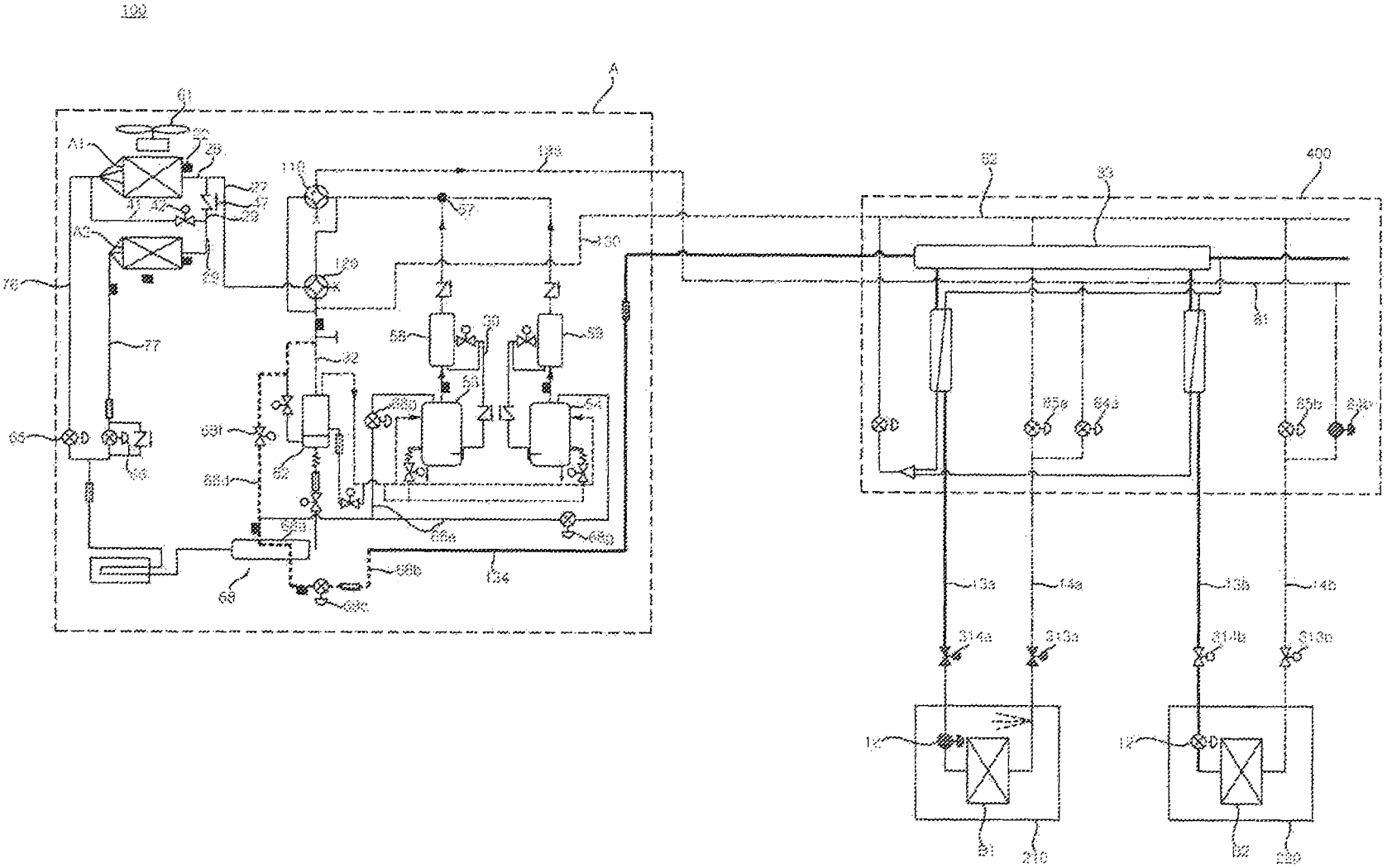
FIG. 7 is a view of a simultaneous heating-only operation of a multi-air conditioner for heating and cooling according to another embodiment.

In the heating-only mode of FIG. 7, the high-temperature, high-pressure refrigerant compressed in the compressors 53 and 54 is introduced into the indoor unit B1 and B2 and condensed. More specifically, the second four-way valve 120 is set to the ON mode in which the refrigerant discharged from the compressors 53 and 54 does not pass through the second four-way valve 120. The first four-way valve 110 is set to the OFF mode in which the refrigerant discharged from the compressors 53 and 54 passes through the first four-way valve 110. The second four-way valve 120 connects the outdoor heat exchangers A1 and A2 and the compressors 53 and 54. That is, the second four-way valve 120 connects the outdoor heat exchanger-first four-way valve connecting pipeline 27 and the accumulator inlet pipeline 32, so that the refrigerant discharged from the outdoor heat exchangers A1 and A2 flows to the compressors 53 and 54 through the accumulator 52. The first four-way valve 110 sends refrigerant discharged from the compressors 53 and 54 to the gas pipe connecting pipeline 138 connected to the indoor unit B. That is, the first four-way valve 110 connects the compressor discharge pipeline 34 and the gas pipe connecting pipeline 138. The accumulator inlet pipeline 32 is branched to the common pipe 130, and a portion of the refrigerant from the indoor unit B flows to the accumulator inlet pipeline 32 through the common pipe 130.

In the heating mode, the liquid pipe valve, the gas pipe valve, and the common pipe valve are also opened. The flow of refrigerant in the heating mode will be described. A refrigerant discharged from the compressors 53 and 54 flows to the gas pipe connecting pipeline 138 through the first four-way valve 110. The refrigerant flowing through the gas pipe connecting pipeline 138 flows to the indoor unit B and evaporates as the high-pressure control valve 85 of the distributor 400 is opened. The refrigerant condensed in the indoor unit B is introduced into the indoor liquid pipe 13 and the liquid header 83 and then into the outdoor unit A through the liquid pipe connecting pipeline 134. The refrigerant introduced into the outdoor unit A flows to the outdoor heat exchangers A1 and A2 through the outdoor expansion valves 65 and 66. The refrigerant evaporated in the outdoor heat exchangers A1 and A2 flows to the second four-way valve 120, and flows to the compressors 53 and 54 through the accumulator 52.

When a refrigerant leak is detected in this flow, a refrigerant leak detection operation is executed as shown in FIG. 7. More specifically, during the heating operation, if a leak occurs in the indoor gas pipe 14*a* or indoor liquid pipe 13*a*, the controller 15 of the indoor unit B transmits a corresponding detection signal to a controller (not shown) of the outdoor unit A via outdoor unit-indoor unit communication first, and then the controller of the outdoor unit A starts a refrigerant leak detection operation.

Upon receiving a leak detection signal, the controller closes the refrigerant shut-off valves 313*a* and 314*a* of the corresponding indoor space 210 to block the flow of refrigerant flowing through the refrigerant pipelines 13*a* and 14*a* (S200). In this instance, the liquid pipe shut-off valve 314*a* and the gas pipe shut-off valve 313*a* are closed at the same time, and it takes 90 to 120 seconds for the liquid pipe shut-off valve 314*a* and the gas pipe shut-off valve 313*a* to close.

In order to prevent refrigerant flowing in the liquid pipe connecting pipeline 134 and gas pipe connecting pipeline 138 from continuing to leak to the indoor space 210 during such a relatively long period of time, the controller performs an operation for lowering the pressure of the liquid pipe connecting pipeline 134 and gas pipe connecting pipeline 138 in which a high-pressure refrigerant flows. More specifically, the first outdoor expansion valve 65 and the second outdoor expansion valve 66 are closed, and the indoor expansion valve 12 of the corresponding indoor space 210 is also shut off, thereby abruptly decreasing the flow of refrigerant. Also, the low-pressure control valve 84*a* and high-pressure control valve 85*a* of the distributor 400 connected to the indoor unit B1 of the corresponding indoor space 210 are both opened, so that gas refrigerant flowing through the two valves is mixed, whereby the gas refrigerant is stopped from flowing to the indoor heat exchanger B1. Moreover, if a leak occurs in the indoor gas pipe 14*a*, low and high pressure refrigerant is bypassed, which may significantly reduce the pressure of the pipeline where the leak has occurred and therefore lead to a reduction in refrigerant leak.

The first outdoor expansion valve 65 and the second outdoor expansion valve 66 are closed, and the subcooling expansion valve 68*c* and subcooling bypass valve 68*f* of the subcooling unit 68 are opened at the same time (S300). Once the first outdoor expansion valve 65 and the second outdoor expansion valve 66 are closed, refrigerant passed through the subcooling unit 68 does not pass through the first outdoor expansion valve 65 and the second outdoor expansion valve 66 and does not flow to the outdoor heat exchangers A1 and A2.

Moreover, the subcooling expansion valve 68*c* and subcooling bypass valve 68*f* of the subcooling unit 68 are opened at the same time, so that the high-pressure refrigerant in the liquid pipe connecting pipeline 134 is bypassed to the subcooling bypass pipeline 68*b* and bypassed through the accumulator bypass pipeline 68*d*. In this instance, the low pressure control valve 84*a*, the high-pressure control valve 85*a*, the subcooling expansion valve 68*c*, and the subcooling bypass valve 68*f* may be solenoid valves and have a faster response speed than the shut-off valves 313*a* and 314*a*.

Thus, a low-pressure output of the accumulator 52 is connected through a bypass to the liquid pipe connecting pipeline 134 connected to the indoor liquid pipe 13. Accordingly, the low pressure outlet is instantaneously bypassed to the high-pressure liquid pipe connecting pipeline 134, thereby making the pressure in that pipeline very low.

Once the pressures at the liquid pipe connecting pipeline 134 and the indoor liquid pipe 13 are lowered, the amount of refrigerant flowing through the pipelines 134 and 13 decreases abruptly while the shut-off valves 313*a* and 314*a* are closed, resulting in a significant reduction in the amount of refrigerant leakage flowing indoors. The controller may measure the compression ratio of the compressors 53 and 54, and if the compression ratio is higher than a minimum compression ratio (S400), the controller may control the compressors 53 and 54 such that their operating frequency is maintained or decreased. In this instance, the rate of increase in power or current consumption of the air conditioner 100 may be relatively low (S500).

If the compression ratio of the compressors 53 and 54 is lower than or equal to the minimum compression ratio (S600), it means that the low pressure at inputs of the compressors 53 and 54 is very high. From this, it can be inferred that the shut-off valves 313*a* and 314*a* are completely shut off when the pressures at the liquid pipe connecting pipeline 134 and the output of the accumulator 52, which are connected through a bypass, have risen to a similar level. Accordingly, the system is stopped by stopping the compressors 53 and 54 (S600). Next, if the controller receives a corresponding detection signal after ascertaining that the leak shut-off valves 313*a* and 314*a* are completely closed (S700), it reports the occurrence of the refrigerant leak to the user or the person in charge by sending a repair request (S800).

Figure 8A:
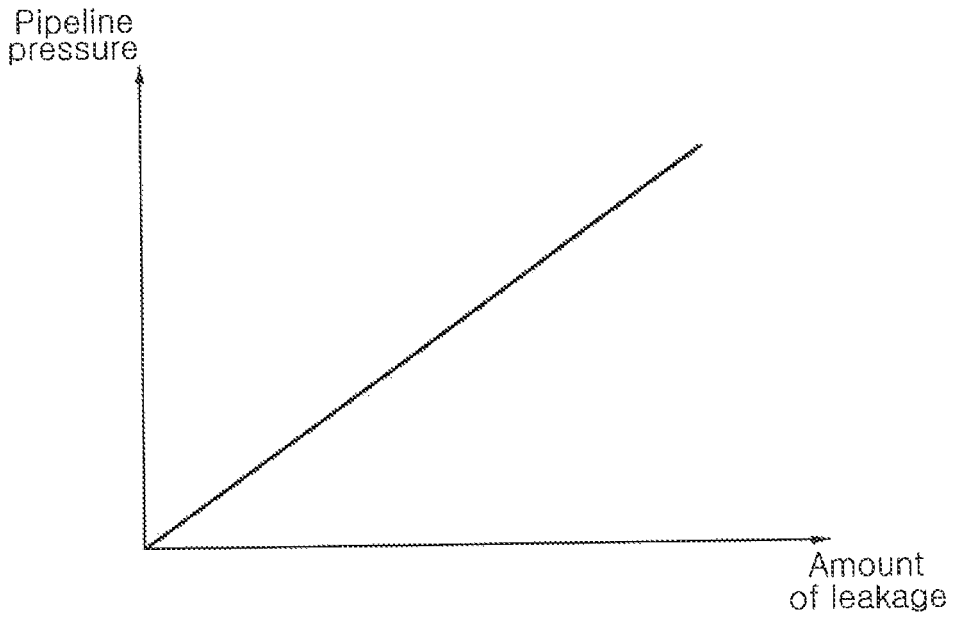
FIGS. 8A and 8B are graphs showing a leak reduction effect obtained by embodiments.
Figure 8B:
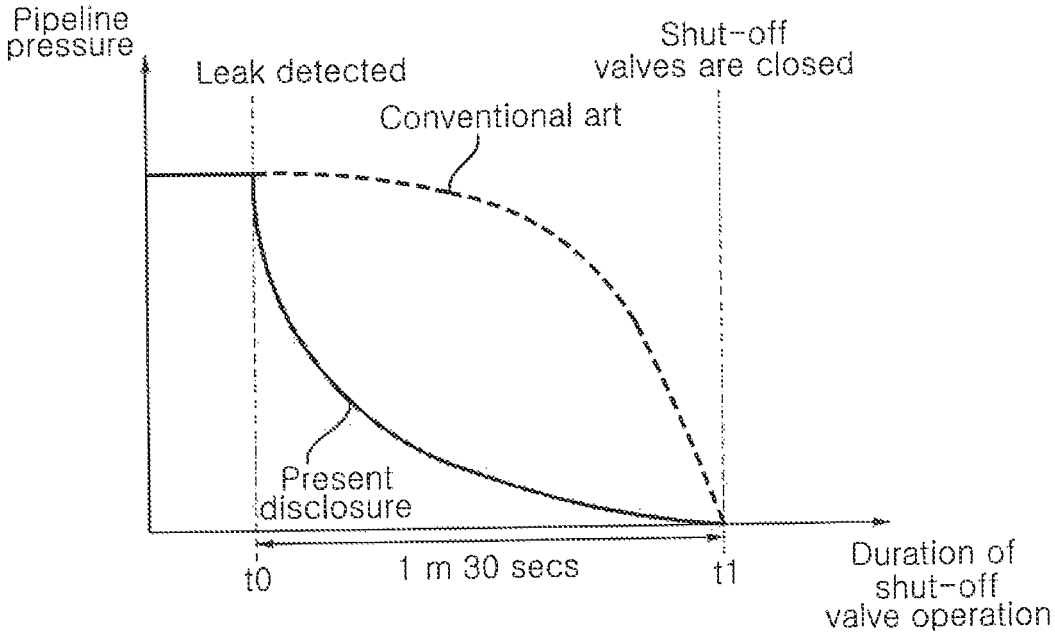

Referring to the graphs of FIGS. 8A and 8B, when a fluid leak occurs in a particular pipeline, the amount of leakage is proportional to the pressure of that pipeline, as depicted in FIG. 8A. Based on this, the change in pipeline pressure over time during operation of a shut-off valve in FIG. 8B will be examined. Suppose that a refrigerant leak is detected at t0 and the shut-off valve is completely shut off at t1. In the conventional art, the amount of leakage per unit time decreases until the shut-off valve is completely closed but the leak still continues. Due to this leak, the pipeline pressure gradually decreases as a logarithm function. Accordingly, in embodiments, by rapidly decreasing the pressure of a pipeline with a leak as soon as the leak is detected, the amount of refrigerant leakage through that pipeline may be significantly reduced.

In embodiments, when using the refrigerant shut-off valves 313*a*, 314*a*, 313*b*, and 314*b*, the refrigerant shut-off valves 313*a*, 314*a*, 313*b*, and 314*b* may be located at a position outside of the indoor space 210 and 220, thereby minimizing the amount of refrigerant remaining in the indoor space 210 and 220. In this instance, the amount of refrigerant flowing within the system may be significantly reduced by closing every expansion valve first, and then, in order to reduce the amount of leakage until the shut-off valves 313*a*, 314*a*, 313*b*, and 314*b* are completely shut off, both the low-pressure control valve 84*a* and the high-pressure control valve 85*a* may be opened to connect the low-pressure common pipe 130 and the high-pressure gas pipe connecting pipeline 138 through a bypass, in case a leak occurs in the indoor gas pipe, or the low pressure at the inputs of the compressors 53 and 54 may be bypassed to the refrigerant pipelines 314 and 13, thereby significantly reducing the amount of refrigerant leaking.

Embodiments disclosed herein provide an air conditioning system that can minimize an amount of refrigerant leakage when a refrigerant leaks. Embodiments disclosed herein further provide an air conditioning system that employs a shut-off valve in the case of a refrigerant leak and sets the shut-off valve in an optimal position to block the flow of refrigerant, thereby minimizing any effects on the user. Embodiments disclosed herein furthermore provide a multi-air conditioner for heating and cooling that can reduce a total amount of refrigerant leak by decreasing the pressure in a liquid pipe, so as to minimize the amount of refrigerant that leaks while the shut-off valve is being closed.

Embodiments disclosed herein provide a multi-air conditioner for heating and cooling that may include at least one indoor unit installed in an indoor space and including an indoor heat exchanger and an indoor expansion valve; an outdoor unit connected to the indoor unit via a refrigerant pipeline and including an outdoor heat exchanger, a compressor, an outdoor expansion valve, and a four-way valve; and at least one leak shut-off valve provided on the refrigerant pipeline, that blocks a flow of refrigerant in the refrigerant pipeline when a refrigerant leak from the refrigerant pipeline occurs in the indoor space. The outdoor unit may decrease a pressure of the refrigerant pipeline when a refrigerant leak occurs from the refrigerant pipeline. The at least one leak shut-off valve may be installed outside of the indoor space in which the indoor unit is installed.

The outdoor unit may include a subcooling unit that cools the refrigerant from the outdoor heat exchanger and directs the same to the refrigerant pipeline, and an accumulator that stores the refrigerant and provides the same to the compressor. The refrigerant pipeline may include a liquid pipe connecting pipeline through which a high-pressure liquid refrigerant flows, and a gas pipe connecting pipeline through which a high-pressure gas refrigerant flows. The subcooling unit may be connected to the liquid pipe connecting pipeline to cool the refrigerant in the liquid pipe connecting pipeline.

The subcooling unit may include a subcooling heat exchanger; a subcooling bypass pipeline bypassed from the liquid pipe connecting pipeline and connected to the subcooling heat exchanger; a subcooling expansion valve disposed on the subcooling bypass pipeline to selectively expand a refrigerant flowing therein; an accumulator bypass pipeline that connects the accumulator and the subcooling heat exchanger; and a subcooling bypass valve disposed on the accumulator bypass pipeline to manage a flow of the refrigerant between the accumulator and the subcooling heat exchanger. When the refrigerant leaks from the refrigerant pipeline, the subcooling expansion valve and the subcooling bypass valve may be opened to reduce the refrigerant pipeline to a low pressure.

Every outdoor expansion valve in the outdoor unit may be closed at the time of the refrigerant leak. Further, every indoor expansion valve in the indoor unit may be closed at the time of the refrigerant leak.

The leak shut-off valve may take longer to open or close than the subcooling expansion valve and the subcooling bypass valve. When a refrigerant leak is detected from the indoor space, the subcooling expansion valve may be fully opened.

The multi-air conditioner for heating and cooling may further include a leak detection sensor that detects a refrigerant leak from the refrigerant pipeline in the indoor space, and an indoor unit controller that, upon receiving a leak detection signal from the leak detection sensor, transmits the leak detection signal to the outdoor unit. The outdoor unit may further include a controller that, upon receiving the leak detection signal from the indoor unit controller, controls the compressor, the indoor expansion valve, the outdoor expansion valve, the four-way valve, the leak shut-off valve, the subcooling expansion valve, and the subcooling bypass valve.

The multi-air conditioner for heating and cooling may further include a distributor disposed between the outdoor unit and the at least one indoor unit, that distributes the refrigerant to the at least one indoor unit according to a cooling or heating operation mode.

The distributor may include a low-pressure valve that directs a low-pressure gas refrigerant to a gas pipeline connected to the indoor unit, and a high-pressure valve that directs a high-pressure gas refrigerant to a gas pipeline connected to the indoor unit. The distributor may include a liquid header connected to the liquid pipe connecting pipeline; a low-pressure gas header connected to a common pipe of the outdoor unit; and a high-pressure gas header connected to the gas pipe connecting pipeline so that refrigerant flowing therein has a higher pressure than refrigerant flowing in the low-pressure gas header. When a refrigerant leak is detected, both the low-pressure valve and the high-pressure may be opened.

Embodiments disclosed herein allow for minimizing an amount of refrigerant leakage when a refrigerant leaks by collecting refrigerant in a buffer tank. Further, embodiments disclosed herein employ a shut-off valve in case of a refrigerant leak and sets the shut-off valve in an optimal position to block the flow of refrigerant, thereby minimizing any effects on the user. In addition, it is possible to reduce the total amount of refrigerant leak by decreasing the pressure in a liquid pipe, so as to minimize the amount of refrigerant that leaks while the shut-off valve is closed.

While embodiments have been illustrated and described above, the embodiments are not limited to the aforementioned embodiments, and various modifications may be made by a person with ordinary skill in the art to which the embodiments pertain without departing from the subject matter claimed in the claims, and these modifications should not be appreciated individually from the technical spirit or prospect.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a multi-air conditioner for heating and cooling, the multi-air conditioner comprising at least one indoor unit installed in an indoor space and comprising an indoor heat exchanger and an indoor expansion valve, an outdoor unit connected to the indoor unit via a refrigerant pipeline and comprising at least one outdoor heat exchanger, at least one compressor, at least one outdoor expansion valve, and at least one four-way valve, and at least one leak shut-off valve provided on the refrigerant pipeline, a subcooling unit having a subcooling heat exchanger that cools the refrigerant from the outdoor heat exchanger and runs the refrigerant to the refrigerant pipeline, an accumulator that stores the refrigerant and provides the refrigerant to the compressor; an accumulator bypass pipeline that connects the accumulator and the subcooling heat exchanger, and a subcooling bypass valve disposed on the accumulator bypass pipeline, the method comprising:

detecting a refrigerant leak from the refrigerant pipeline in the indoor space;

upon detecting the refrigerant leak, blocking a flow of refrigerant by closing the at least one leak shut-off valve installed on the refrigerant pipeline; and opening the subcooling bypass valve to connect the refrigerant pipeline to an output terminal of the accumulator for decreasing a pressure of the refrigerant in the refrigerant pipeline while the at least one leak shut-off valve is closed.

2. The method of claim 1, further comprising measuring a compression ratio of the at least one compressor while the at least one leak shut-off valve is closed and stopping the at least one compressor if the compression ratio is lower than or equal to a predetermined compression ratio.

3. The method of claim 1, further comprising, when the at least one leak shut-off valve is completely closed, reporting occurrence of the refrigerant leak to a user or a person in charge by sending a repair request.

* * * * *